United States Patent [19]

Maran

[11] 3,991,527

[45] Nov. 16, 1976

[54] COATED ABRASIVE DISC

[75] Inventor: Armand C. Maran, Deerfield, Ill.

[73] Assignee: Bates Abrasive Products, Inc., Chicago, Ill.

[22] Filed: July 10, 1975

[21] Appl. No.: 594,626

[52] U.S. Cl. ..... 51/397; 51/405; 51/407

[51] Int. Cl.[2] ..... B24D 13/14

[58] Field of Search ..... 51/394–398, 51/401, 402, 405, 407

[56] References Cited

UNITED STATES PATENTS

| | | | |
|---|---|---|---|
| 2,001,911 | 5/1935 | Wooddell | 51/397 |
| 2,334,642 | 11/1943 | Moore | 51/397 X |
| 2,682,735 | 7/1954 | Buckner | 51/407 |
| 2,907,146 | 10/1959 | Dyar | 51/397 |
| 3,324,608 | 6/1967 | Hoenig | 51/395 |
| 3,605,349 | 9/1971 | Anthon | 51/407 |
| 3,609,925 | 10/1971 | Comella-Riera | 51/402 |
| 3,641,719 | 2/1972 | Yang | 51/402 |
| 3,774,355 | 11/1973 | Dawson | 51/395 |

*Primary Examiner*—Al Lawrence Smith
*Assistant Examiner*—Nicholas P. Godici
*Attorney, Agent, or Firm*—Charles B. Cannon

[57] ABSTRACT

A coated abrasive disc is prepared for use in power driven abrading, grinding, buffing tools and the like, by coating a substrate disc or sheet of fibrous paperboard, or like material, as by means of a patterned adhesive transfer roll, embossing or the like, to form rows of geometrically patterned adhesive coated areas in the substrate; and then applying finely divided abrasive material over the adhesive coated areas to form a geometrical pattern of abrasive coated areas on the substrate with rows of uncoated scavenging channels extending between the abrasive coated areas and opening onto the outer or peripheral edge of the abrasive coated disc. In the use of the new abrasive coated disc the scarfings or debris from the operation of the abrasive coated disc, as when used on a metal surface, or the like, are discharged by centrifugal force through the uncoated scavenging channels to the outer or peripheral edge of the new abrasive coated disc, thereby enhancing the efficiency and use of the new abrasive coated disc.

3 Claims, 12 Drawing Figures

COATED ABRASIVE DISC

OBJECTS OF THE INVENTION

An object of the invention is to provide a new and improved abrasive coated disc for use in power driven abrading, grinding, buffing tools, and the like.

Another object of the invention is to provide a new and improved abrasive coated disc which, in use, effectively eliminates the scarfings which are formed when the new abrasive coated disc is used in abrading, grinding or buffing metal surfaces, or the like, thereby increasing the efficiency of the new abrasive coated disc.

A further object of the invention is to provide a novel method of making a new abrasive coated discs.

Other objects will appear hereinafter.

DESCRIPTION OF FIGURES IN THE DRAWINGS

Figures 1, 2, 3, 4, 5, 6:
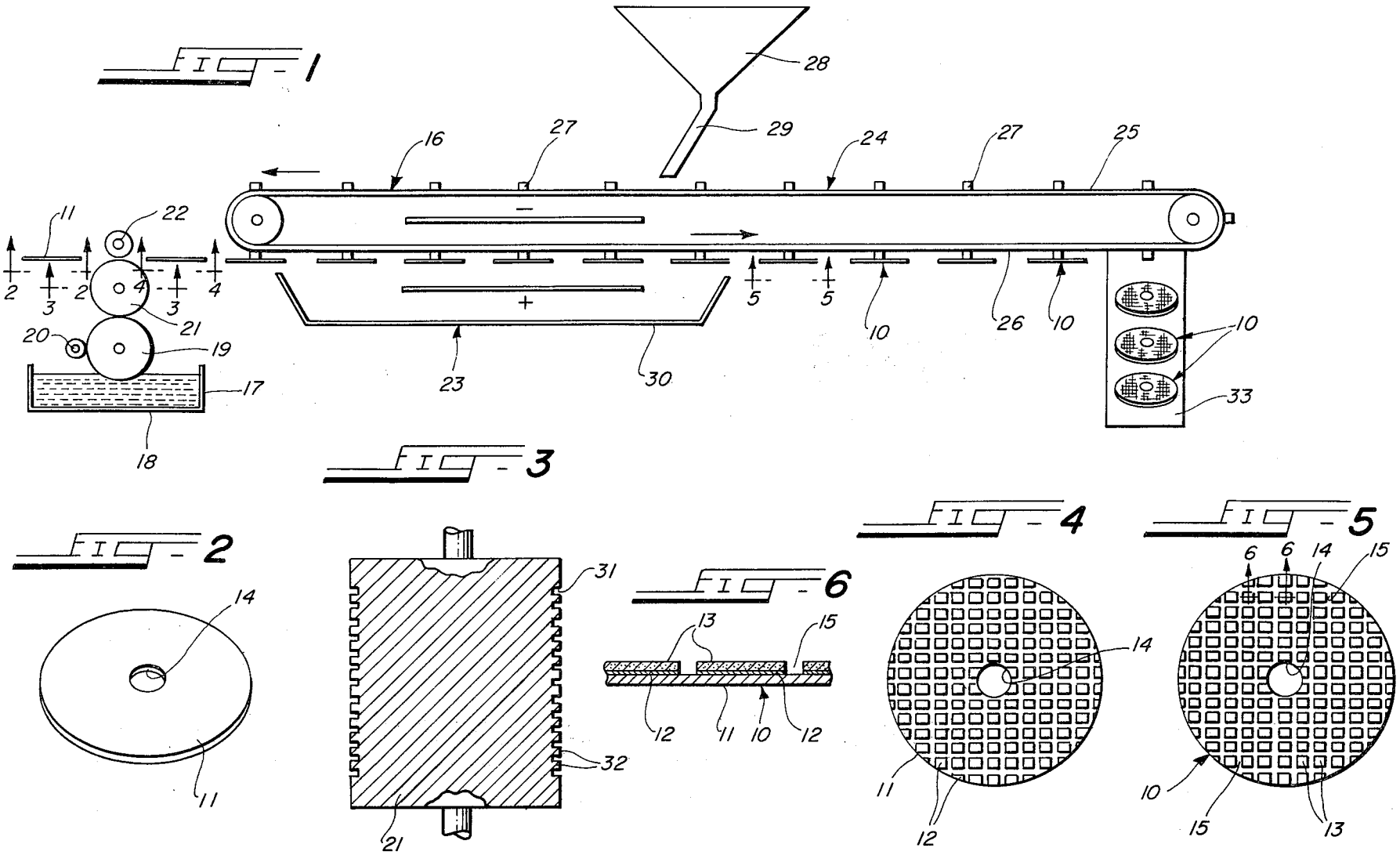
FIG. 1 is a schematic flow diagram illustrating a typical and suitable apparatus and method for making the new abrasive coated discs.
FIG. 2 is a perspective view of a disc of fiberboard or like materials used as the substrate in making the new abrasive coated discs.
FIG. 3 is an enlarged sectional view on line 3—3 in FIG. 1 illustrating a geometrically patterned adhesive transfer roll which is embodied in the apparatus illustrated in FIG. 1 for making the new abrasive coated discs.
FIG. 4 is a bottom plan view on line 4—4 in FIG. 1 illustrating the adhesively coated fiberboard or like substrate prior to the application of the adhesive thereon.
FIG. 5 is a bottom plan view on line 5—5 in FIG. 1 illustrating the construction of the new abrasive coated disc after the application of the abrasive material thereto.
FIG. 6 is an enlarged sectional view on line 6—6 in FIG. 5 illustrating the construction of the new abrasive coated disc.

A preferred and typical embodiment of the new abrasive coated disc is illustrated in FIGS. 4, 5 and 6 of the drawings, wherein it is generally indicated at 10, and comprises a smooth uninterrupted base sheet or substrate 11 of fiberboard, or like material, having geometrically patterned, as square or rectangular, areas 12 on its upper or outer surface and which are coated with an adhesive such, for example, as a phenol-formaldehyde resin; the abrasive coated disc 10 being provided with a centrally arranged opening 14 to enable the new abrasive coated disc 10 to be mounted on the spindle of a power driven abrading or grinding tool. As shown in FIGS. 5 and 6, the new abrasive coated disc 10 has a series of rows of geometrically patterned, as square or rectangular, areas 12, which are formed by coating the correspondingly shaped and sized adhesively coated areas 12 with finely divided abrasive material such, for example, as silicon carbide, aluminum axoide, or the like, of suitable particle size, and which may vary preferably from 24 grit (coarse) to 320 grit (fine).

As shown in FIGS. 5 and 6, rightangularly intersecting channels 15 are formed in the new abrasive coated areas 12–13 and these channels open onto the outer or peripheral edge of the new abrasive coated disc 10.

A suitable and typical apparatus and method for making the new abrasive coated disc 10 is illustrated in FIGS. 1 and 3 of the drawings, wherein it is generally indicated at 16, and comprises a receptacle or pan 17 for an adhesive, such as a liquid phenol-formaldehyde resin, in which an adhesive feed roll 19 works. The adhesive from the adhesive feed roll 19 is supplied to a geometrically patterned adhesive transfer roll 21 against which a hold-down roll 22 works.

The coating apparatus 16 includes an electrostatic coating apparatus 23 which includes an endless conveyor 24 having an upper run 25 and a lower run 26 which travel through the electrostatic coating apparatus 23 and suitable carriers or supports 27 for the adhesively coated discs 11-12-14 of FIG. 4 are mounted at spaced intervals on the conveyor 24. An abrasive supply hopper 28-29 is mounted above the upper run 25 of the endless conveyor 24 and is adapted to supply the finely divided abrasive to a receptacle or pan 30 (FIG. 1), and a takeaway conveyor 33 is arranged at the discharge end of the endless conveyor 24.

The geometrically patterned adhesive transfer roll 21 has a series or rows of circumferentially extending or annular grooves 31 formed in its external surface, thereby forming corresponding circumferentially extending or annular ridges 32 in the transfer roll 21 (FIG. 3).

It will be noted that the bottom surface of each of the scavenging channels 15 extends to the upper surface of the fibrous disc-shaped base sheet or substrate 11, which is uncoated, and that the upper surface of each of the scavenging channels 15 is coplanar with the upper surface of the coating 13 of finely divided abrasive material, and that each of the scavenging channels 15 is generally rectangular in cross sectional form and is shown as being of substantially uniform width from its upper surface to its bottom surface.

OPERATION OF THE APPARATUS SHOWN IN FIGS. 1 AND 3

In the manufacture of the new abrasive coated discs 101 by means of the apparatus shown in FIGS. 1 and 3, a suitable liquid adhesive, such as phenol-formaldehyde resin 18, is supplied in the adhesive receptacle or pan 17, from which it is fed by the adhesive feed roll 19 to the geometrically patterned adhesive transfer roll 21 and thence to the bottom surface of the fiberboard or like substrate discs 11 as the latter are fed into the electrostatic coating apparatus 23 in any suitable manner, thereby coating the bottom surfaces of the fiberboard or substrate discs 11 with a geometrical pattern of adhesively coated areas 12.

As the thus adhesively coated fiberboard or substrate discs 11–12 (FIG. 4) leave the adhesive coating unit 17-19-21-22 they are fed into the electrostatic coating apparatus 23 and are picked up by the supporting units or carriers 27 on the lower run of the endless conveyor 24 by which they are fed into and through the electrostatic abrasive-coating apparatus 23 in which the geometrically adhesively coated areas on the adhesively coated substrate discs 11–12 (FIG. 4) are provided with a coating of the finely divided abrasive material 13, thereby completing the new abrasive coated discs 10 of FIGS. 5 and 6.

As the new abrasive coated discs 10 are thus completed the uncoated geometric pattern of uncoated parallel rows of intersecting scavenging channels 15 are formed therein between the adhesively coated abrasive areas 2–13, and in the use of the new abrasive coated discs 10 these channels serve as scavenging channels which effectively discharge the scarfings or debris from the abrading, grinding or like operation, since the scarfings or debris are thrown out of these channels 15 at the peripheral or outer edge of the new abrasive coated disc 10, under the centrifugal force due to rotation thereof in use.

THE MODIFICATION SHOWN IN FIGS. 7 TO 12, INCLUSIVE

Figure 9:
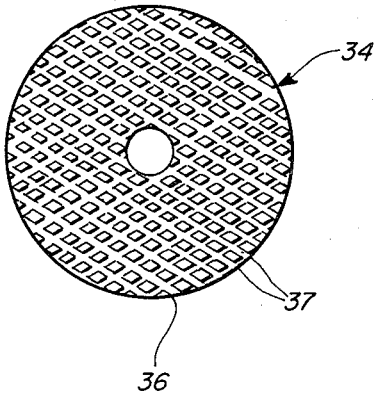
FIG. 9 is a bottom plan view on line 9—9 in FIG. 7 illustrating the substrate embodied in the modified form of the new abrasive coated disc as shown in FIGS. 11 and 12.
Figure 11:
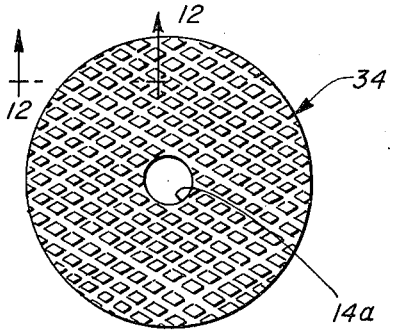
FIG. 11 is a top plan view illustrating a modified form of the new abrasive coated disc after the adhesive material has been applied to the abrasive coated substrate illustrated in FIG. 9.
Figure 12:
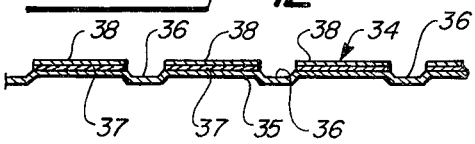
FIG. 12 is an enlarged fragmentary sectional view on line 12—12 in FIG. 11.

A modified form of the new abrasive coated disc is illustrated in FIGS. 9, 11 and 12 of the drawings, wherein it is generally indicated at 34, and comprises a substrate disc of fiberboard or like material 35 (FIG. 7) which is provided with geometrically patterned rows of embossed channels 36 with a coating of adhesive material 37, such as phenol-formaldehyde resin, or the like, provided over the surface of the embossed substrate 35 in the areas between the embossed channels 36. A coating of finely divided abrasive material, such as hereinbefore described, is provided over the adhesively coated areas 37.

Figure 7:
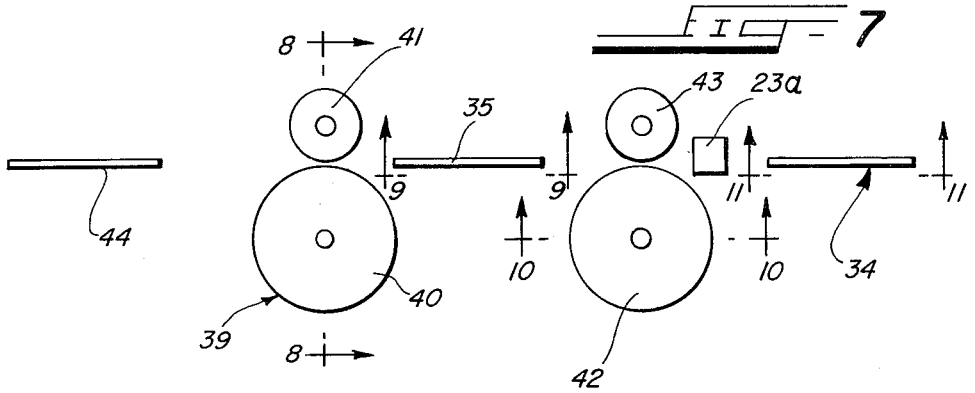
FIG. 7 is a schematic flow diagram illustrating a modified form of the apparatus for making a modified form of the new abrasive coated discs, as shown in FIGS. 9, 11 and 12.
Figure 8:
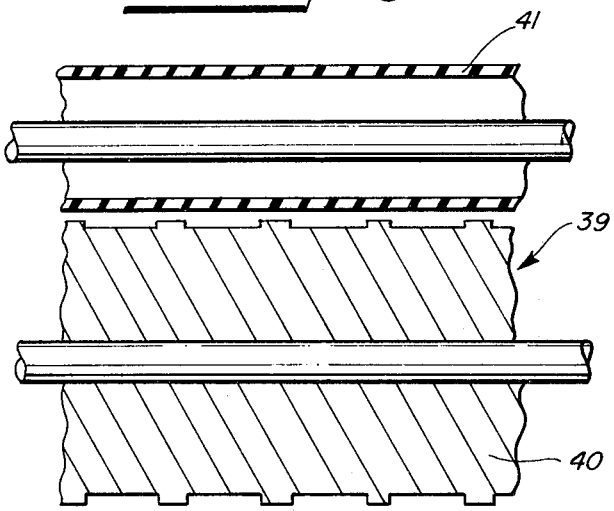
FIG. 8 is an enlarged sectional view on line 8—8 in FIG. 7 illustrating an embossing roll which is embodied in the apparatus illustrated in FIG. 7.
Figure 10:
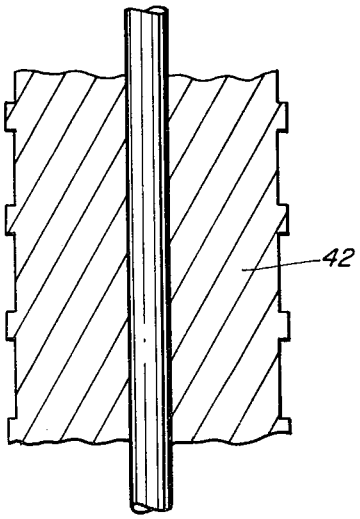
FIG. 10 is an enlarged sectional detail view on line 10—10 in FIG. 7, illustrating the geometrically patterned adhesive coating roll which is embodied in the modified form of apparatus illustrated in FIG. 7.

A typical and suitable apparatus for making the new embossed abrasive coated disc 34 (FIGS. 9, 11 and 12) is illustrated in FIGS. 7, 8 and 10 of the drawings, wherein it is generally indicated at 39, and comprises a geometrically patterned embossing roll and a resilient rubber or like hold-down roll 41, a geometrically patterned coating roll 42, and a doctor roll 43.

In the practice of the modified form of the invention illustrated in FIGS. 7 to 12, inclusive, the unembossed fiberboard or like substrate discs 44 are fed between the geometrically patterned embossing roll 40 and the hold-down roll 41 by which they are provided with the geometrical pattern of embossed channels 36 (FIGS. 9 and 11). The thus embossed substrate discs 35 are then fed between the geometrically patterned adhesive coating roll 42 and the doctor roll 43 by which they are provided with the coating 37 of adhesive material in the unembossed areas thereof.

The thus embossed and adhesively coated substrate discs 35–37 are then fed into and through an electrostatic coating apparatus, 23*a*, such as 23 (FIG. 1) by which the adhesively coated and unembossed areas 37 are provided with a coating 38 of finely divided abrasive material, such as hereinbefore described, thereby completing the making of the embossed and adhesive and abrasive coated disc 34 which is provided with a centrally arranged circular opening 14*a* to enable it to be mounted on the spindle of a power driven tool, as hereinbefore described.

It will thus be seen from the foregoing description, considered in conjunction with the accompanying drawings, that the present invention provides a new and improved abrasive coated disc, and a new and improved method of making the same, having the desirable advantages and characteristics and accomplishing its intended objects including those hereinbefore pointed out and others which are inherent in the invention.

I claim:

1. An abrasive coated disc comprising:

a. a fibrous disc-shaped base sheet or substrate having a peripheral edge and including a surface having thereon b. a geometrically arranged pattern of spaced adhesively coated areas;

c. a coating of finely divided abrasive material over each of the said adhesively coated areas;

d. uncoated scavenging channels between the said adhesively coated and abrasive coated areas extending across the said fibrous disc-shaped base sheet or substrate between the said adhesively coated and abrasive coated areas and opening outwardly onto the said peripheral edge of the said abrasive coated disc for the discharge of the scarfings formed by the said abrasive coated disc during engagement thereof with a metal or like surface in use; and e. the said scavenging channels being in the form of embossed channels formed in the said fibrous disc-shaped base sheet or substrate.

2. An abrasive coated disc as defined in claim 1 in which a. the said scavenging channels are arranged in generally parallel intersecting rows; and in which b. the said geometrically arranged pattern of spaced adhesively coated areas and the coating of finely divided abrasive material over each of the said adhesively coated areas is in the form of generally parallel rows of geometrically patterned areas separated by the said scavenging channels.

3. An abrasive coated disc as defined in claim 2 in which a. the said fibrous disc-shaped base or substrate has (1) an upper surface; and in which b. the said embossed scavenging channels are in the form of uncoated areas on the said upper surface of the said fibrous disc-shaped base or substrate between the said adhesively and abrasive coated areas.

* * * * *